US009074358B2

(12) United States Patent
Ball et al.

(10) Patent No.: US 9,074,358 B2
(45) Date of Patent: Jul. 7, 2015

(54) DRAIN ASSEMBLY FOR A BATHTUB AND THE LIKE

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 374 days.

(21) Appl. No.: 13/726,840

(22) Filed: Dec. 26, 2012

(65) Prior Publication Data

US 2013/0180045 A1 Jul. 18, 2013

Related U.S. Application Data

(63) Continuation-in-part of application No. 13/461,422, filed on May 1, 2012, now Pat. No. 8,505,132, which is a continuation-in-part of application No. 12/057,660, filed on Mar. 28, 2008, now Pat. No. 8,166,584, which is a continuation-in-part of application No. 10/732,726, filed on Dec. 10, 2003, now Pat. No. 8,302,220, which is a continuation-in-part of application No. 09/954,420, filed on Sep. 17, 2001, now Pat. No. 6,691,411.

(51) Int. Cl.

| | |
|---|---|
| ***E03C 1/22*** | (2006.01) |
| ***E03C 1/24*** | (2006.01) |
| ***E03C 1/23*** | (2006.01) |

(52) U.S. Cl.
CPC ... *E03C 1/24* (2013.01); *E03C 1/22* (2013.01); *E03C 1/2306* (2013.01)

(58) Field of Classification Search
CPC ..... E03C 1/24
USPC ..... 4/679–694
See application file for complete search history.

(56) References Cited

U.S. PATENT DOCUMENTS

| | | | |
|---|---|---|---|
| 37,956 | A | 3/1863 | Dovtt |
| 427,478 | A | 5/1890 | McEvoy |

(Continued)

FOREIGN PATENT DOCUMENTS

| | | |
|---|---|---|
| CH | 346187 | 4/1960 |
| DE | 1163257 | 2/1964 |
| FR | 744099 | 2/1964 |

OTHER PUBLICATIONS

Definition of the term "diaphragm" found at: http://www.thefreedictionary.com/diaphragm, cited in Aug. 7, 2012 OA for U.S. Appl. No. 13/234,030.

(Continued)

*Primary Examiner* — Lori Baker
(74) *Attorney, Agent, or Firm* — Sheridan Ross P.C.

(57) ABSTRACT

A drain assembly including a drain pipe with a threaded portion and a nut. The drain pipe includes a first end, an elbow portion, and a second end. The first end includes an annular flange and the threaded portion. To interconnect the drain assembly to a bathtub, the second end of the drain pipe is inserted through a drain port of the tub until the annular flange abuts a bottom wall of the tub. The nut is then threaded onto the threaded portion of the drain pipe to secure the drain pipe to the bathtub. The second end of the drain pipe is then interconnected to drain plumbing.

18 Claims, 9 Drawing Sheets

(56) References Cited

U.S. PATENT DOCUMENTS

| | | | |
|---|---|---|---|
| 843,968 | A | 2/1907 | Sharp, Jr. |
| 1,213,466 | A | 1/1917 | Delanoy |
| 1,330,909 | A | 2/1920 | Sharp, Jr. |
| 1,518,599 | A | 12/1924 | Murray |
| 1,788,083 | A | 1/1931 | Church |
| 1,925,008 | A | 8/1933 | Schact |
| 1,977,177 | A | 10/1934 | De Flores |
| 2,044,253 | A | 6/1936 | Morris |
| 2,062,145 | A | 11/1936 | Pickop |
| 2,223,365 | A | 12/1940 | Groeniger |
| 2,374,815 | A | 5/1945 | Haas, Jr. |
| 2,444,340 | A | 6/1948 | Donahue |
| 2,832,081 | A | 4/1958 | Young |
| 2,915,903 | A | 12/1959 | Digby et al. |
| 2,993,655 | A | 7/1961 | O'Brien |
| 3,121,879 | A | 2/1964 | Young |
| 3,493,978 | A | 2/1970 | Hindman et al. |
| 3,937,497 | A | 2/1976 | Studer |
| D248,133 | S | 6/1978 | Shames et al. |
| 4,135,258 | A | 1/1979 | Braga et al. |
| 4,146,939 | A | 4/1979 | Izzi |
| 4,233,697 | A | 11/1980 | Cornwall |
| 4,307,901 | A | 12/1981 | Orberg et al. |
| 4,352,213 | A | 10/1982 | Watts |
| 4,359,790 | A | 11/1982 | Chalberg |
| 4,371,991 | A | 2/1983 | Schrott |
| 4,387,914 | A | 6/1983 | Paulson et al. |
| 4,413,384 | A | 11/1983 | Lassche |
| 4,457,030 | A | 7/1984 | Burry |
| 4,553,625 | A | 11/1985 | Tsuge et al. |
| 4,683,597 | A | 8/1987 | Taylor et al. |
| 4,730,855 | A | 3/1988 | Pelletier |
| D296,816 | S | 7/1988 | Budzinski et al. |
| 4,813,745 | A | 3/1989 | Woody |
| 4,825,477 | A | 5/1989 | Aranda |
| 4,865,353 | A | 9/1989 | Osborne |
| 4,890,967 | A | 1/1990 | Rosenbaum |
| 4,920,582 | A | 5/1990 | Alker |
| 4,953,235 | A | 9/1990 | Cornwall |
| 5,025,509 | A | 6/1991 | Holt et al. |
| 5,257,648 | A | 11/1993 | Oropallo |
| 5,267,474 | A | 12/1993 | Ten Hoven |
| 5,273,077 | A | 12/1993 | Oropallo |
| 5,350,266 | A | 9/1994 | Espey et al. |
| 5,351,996 | A | 10/1994 | Martin |
| 5,377,361 | A | 1/1995 | Piskula |
| 5,417,460 | A | 5/1995 | Lunder |
| 5,507,501 | A | 4/1996 | Palmer |
| 5,590,916 | A | 1/1997 | Liu |
| 5,692,248 | A | 12/1997 | Ball |
| 5,745,931 | A | 5/1998 | Ball |
| 5,758,368 | A | 6/1998 | Ball |
| 5,786,054 | A | 7/1998 | Platusich et al. |
| 5,799,986 | A | 9/1998 | Corbett et al. |
| 5,815,895 | A | 10/1998 | Carlson et al. |
| 5,890,241 | A | 4/1999 | Ball |
| 5,957,514 | A | 9/1999 | Brookshire |
| 5,971,438 | A | 10/1999 | Johnson |
| 6,058,526 | A | 5/2000 | Parisi et al. |
| 6,066,119 | A | 5/2000 | Ball |
| 6,073,278 | A | 6/2000 | Ball |
| 6,085,363 | A | 7/2000 | Huber |
| 6,088,843 | A | 7/2000 | Francisco |
| 6,126,233 | A | 10/2000 | Gaetano et al. |
| 6,145,136 | A | 11/2000 | Parisi et al. |
| 6,192,531 | B1 | 2/2001 | Fritz et al. |
| 6,193,879 | B1 | 2/2001 | Bowman |
| 6,216,288 | B1 | 4/2001 | Bernau |
| 6,226,806 | B1 | 5/2001 | Ball |
| 6,263,518 | B1 | 7/2001 | Magtanong |
| 6,289,532 | B1 | 9/2001 | Fritz et al. |
| 6,295,664 | B2 | 10/2001 | Fritz et al. |
| 6,338,168 | B1 | 1/2002 | Valentine |
| 6,362,734 | B1 | 3/2002 | McQuade et al. |
| 6,418,570 | B1 | 7/2002 | Ball |
| 6,448,907 | B1 | 9/2002 | Naclerio |
| 6,484,331 | B2 | 11/2002 | Minnick |
| 6,530,722 | B1 | 3/2003 | Shaw et al. |
| 6,546,573 | B1 | 4/2003 | Ball |
| 6,606,753 | B2 | 8/2003 | Minnick |
| 6,618,875 | B1 | 9/2003 | Oropallo et al. |
| 6,637,050 | B1 | 10/2003 | Ball |
| 6,675,406 | B2 | 1/2004 | Ball |
| 6,681,420 | B1 | 1/2004 | Ball |
| 6,691,411 | B2 | 2/2004 | Ball |
| 6,696,943 | B1 | 2/2004 | Elrod et al. |
| 6,812,844 | B1 | 11/2004 | Burgess |
| 6,836,911 | B2 | 1/2005 | Minnick |
| 6,953,049 | B2 | 10/2005 | Kowalke |
| D517,666 | S | 3/2006 | Wilk, Jr. et al. |
| D523,123 | S | 6/2006 | Wilk, Jr. et al. |
| 7,127,752 | B2 | 10/2006 | Ball |
| 7,237,280 | B1 | 7/2007 | Holden et al. |
| 7,300,074 | B1 | 11/2007 | Paulson |
| D586,433 | S | 2/2009 | Price et al. |
| 7,503,083 | B2 | 3/2009 | Ball |
| D627,862 | S | 11/2010 | Ball |
| D627,863 | S | 11/2010 | Ball |
| D636,468 | S | 4/2011 | Ball |
| D637,696 | S | 5/2011 | Ball |
| 8,028,357 | B2 | 10/2011 | Ball |
| 8,166,584 | B2 | 5/2012 | Ball |
| D665,062 | S | 8/2012 | Ball |
| 8,302,220 | B2 | 11/2012 | Ball |
| 8,321,970 | B2 | 12/2012 | Ball |
| 2002/0032926 | A1 | 3/2002 | Lewis |
| 2003/0151281 | A1 | 8/2003 | Williams |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0111797 | A1 | 6/2004 | Ball |
| 2006/0085907 | A1 | 4/2006 | Ball |
| 2007/0007763 | A1 | 1/2007 | Deaton |
| 2008/0148477 | A1 | 6/2008 | Shafik |
| 2008/0155745 | A1 | 7/2008 | Burr |
| 2008/0196161 | A1 | 8/2008 | Ball |
| 2009/0261579 | A1 | 10/2009 | Spears |
| 2011/0209279 | A1 | 9/2011 | Ball |
| 2012/0005824 | A1 | 1/2012 | Ball |
| 2012/0246822 | A1 | 10/2012 | Ball |
| 2013/0055494 | A1 | 3/2013 | Ball |
| 2013/0269100 | A1 | 10/2013 | Ball et al. |
| 2013/0340163 | A1 | 12/2013 | Ball et al. |

OTHER PUBLICATIONS

"New WATCO Eliminator Bath Waste", WATCO, as early as Aug. 8, 2001, pp. 1-2.

"Tubular Plastic-Innovator® 590", Woodford Manufacturing Company, first sold Aug. 16, 2001, pp. 1-2.

"WCM Industries-Freezeless Faucets, Yard Hydrants and Bath Wastes", as early as Aug. 2000, available at http://www.woodfordmfg.com/, printed on Sep. 15, 2005, p. 1.

Official Action for U.S. Appl. No. 10/732,726, mailed Mar. 28, 2005.
Official Action for U.S. Appl. No. 10/732,726, mailed May 23, 2005.
Official Action for U.S. Appl. No. 10/732,726, mailed Oct. 24, 2005.
Official Action for U.S. Appl. No. 10/732,726, mailed May 19, 2006.
Official Action for U.S. Appl. No. 10/732,726, mailed Jan. 30, 2008.
Official Action for U.S. Appl. No. 10/732,726, mailed Jun. 2, 2008.
Official Action for U.S. Appl. No. 10/732,726, mailed Aug. 20, 2008.
Official Action for U.S. Appl. No. 10/732,726, mailed Nov. 17, 2008.
Official Action for U.S. Appl. No. 10/732,726, mailed Dec. 9, 2008.
Official Action for U.S. Appl. No. 10/732,726, mailed May 1, 2008.
Official Action for U.S. Appl. No. 10/732,726, mailed Sep. 4, 2009.
Official Action for U.S. Appl. No. 10/732,726, mailed Apr. 15, 2010.
Official Action for U.S. Appl. No. 10/732,726, mailed Oct. 25, 2010.
Official Action for U.S. Appl. No. 10/732,726, mailed May 9, 2011 9 pages.
Official Action for U.S. Appl. No. 10/732,726, mailed Nov. 16, 2011 9 pages.

(56) References Cited

OTHER PUBLICATIONS

Official Action for U.S. Appl. No. 10/674,862, mailed Mar. 28, 2005.
Official Action for U.S. Appl. No. 10/674,862, mailed Aug. 18, 2004.
Notice of Allowance for U.S. Appl. No. 10/674,862, mailed Aug. 24, 2006.
Official Action for U.S. Appl. No. 10/674,862, mailed Oct. 6, 2005.
Official Action for U.S. Appl. No. 10/674,862, mailed Sep. 20, 2005.
Official Communication for U.S. Appl. No. 10/674,862, mailed May 23, 2008.
Examiner's Answer for U.S. Appl. No. 10/674,862, mailed May 15, 2008.
Official Action for U.S Appl. No. 10/674,862, mailed May 1, 2007.
Official Action for U.S. Appl. No. 10/674,862, mailed Dec. 21, 2006.
Notice of Allowance for U.S. Appl. No. 10/738,772, mailed Aug. 1, 2006.
Official Action for U.S. Appl. No. 10/738,772, mailed May 11, 2006.
Official Action for U.S. Appl. No. 10/738,772, mailed Mar. 27, 2006.
Official Action for U.S. Appl. No. 10/738,772, mailed Aug. 2, 2005.
Official Action for U.S. Appl. No. 10/738,772, mailed May 13, 2005.
Official Action for U.S. Appl. No. 10/738,772, mailed Mar. 11, 2005.
Official Action for U.S. Appl. No. 10/738,772, mailed Sep. 17, 2004.
Official Action for U.S. Appl. No. 10/738,765, mailed May 22, 2007.
Official Action for U.S. Appl. No. 10/738,765, mailed Jan. 13, 2006.
Official Action for U.S. Appl. No. 10/738,765, mailed Jun. 6, 2005.
Official Action for U.S. Appl. No. 10/738,765, mailed Apr. 13, 2006.
Notice of Allowability for Design U.S. Appl. No. 29/362,288, mailed Oct. 7, 2010.
Official Action for U.S. Appl. No. 12/057,660, mailed Nov. 3, 2011 9 pages.
Notice of Allowance for U.S. Appl. No. 12/057,660, mailed Mar. 7, 2012 5 pages.
Official Action for U.S. Appl. No. 29/378,602, mailed Mar. 9, 2012 6 pages.
Official Action for U.S. Appl. No. 29/378,602, mailed Mar. 27, 2012 5 pages.
Notice of Allowance for U.S. Appl. No. 29/378,602, mailed Jun. 21, 2012 7 pages.
Official Action for U.S. Appl. No. 13/461,422 mailed Dec. 27, 2012 9 pages.
Notice of Allowance for U.S. Appl. No. 13/461,422 mailed Apr. 18, 2013 6 pages.

DRAIN ASSEMBLY FOR A BATHTUB AND THE LIKE

CROSS REFERENCE TO RELATED APPLICATIONS

This application is a continuation-in-part of pending U.S. patent application Ser. No. 13/461,422, filed May 1, 2012, which is a continuation-in-part of U.S. patent application Ser. No. 12/057,660, filed Mar. 28, 2008, now U.S. Pat. No. 8,166,584, which is a continuation-in-part of U.S. patent application Ser. No. 10/732,726, filed Dec. 10, 2003, now U.S. Pat. No. 8,302,220, which is a continuation-in-part of U.S. patent application Ser. No. 09/954,420, filed Sep. 17, 2001, now U.S. Pat. No. 6,691,411. The entire disclosures of the above-referenced patents and applications are incorporated by reference herein.

BACKGROUND OF THE INVENTION

The traditional method of interconnecting a drain and associated pipes to a bathtub generally comprises engaging a flange of the drain pipe to the bottom surface of the bathtub while aligning an aperture of the flange and the drain outlet of the bathtub, which is a blind operation. Next, while maintaining the position of the flange, a strainer body is inserted into the drain outlet and interconnected to the drain pipe wherein the fflange of the strainer body is engaged on an inside surface of the bathtub. The traditional installation method is cumbersome and difficult as it requires multiple components to be held in place during assembly.

In addition, traditional drain assemblies are difficult to test. More specifically, pipes associated with the bathtub drain and overflow outlet must be leak checked after installation. The leak test involves filling the entire plumbing system with water by way of a vent attached to the drain. After a predetermined amount of time, leaks will be apparent if the water level in the vent pipe falls. To perform the test, the drain outlet is plugged and the overflow port is sealed. Because of risk of damage, plumbers prefer not to use the final closure valve, i.e. stopper, to block the drain. Hence, the common testing method requires the removal of a plumber-supplied plug, which adds a step to the installation method.

Thus, a long felt need exists for a drain assembly that can be installed by a single individual that also facilitates final testing.

SUMMARY OF THE INVENTION

It is one aspect of the present invention to provide a drain assembly that can be installed by one individual. More specifically, in one embodiment of the present invention a drain pipe having a threaded outer surface that receives a nut is provided. The upper edge of the drain pipe includes an outwardly-extending flange that engages the inner surface of the bathtub. The nut threadably engages the threaded portion of the drain pipe from beneath the tub which sandwiches the bottom wall of the bathtub between the flange and the nut. As used herein, a 'tub' may include, but is not limited to, a bathtub or a shower base. Because the drain pipe is positioned within the outlet from inside the bathtub and affixed with the nut after the drain pipe is supported by the bottom surface of the tub, one individual can perform the task. After associating the drain pipe to the tub, the plumber can interconnect the drain pipe to the drain plumbing.

In one embodiment, the drain pipe includes a first end, a second end, and an elbow positioned therebetween. In one embodiment, a maximum diameter of the second end, the elbow portion, and a substantial portion of the first end is less than the diameter of the drain port. Thus, the second end of the drain pipe can be placed through the drain port of the tub and effectively "hang" from the bottom surface of the tub. More specifically, the first end includes an annular flange that has a maximum diameter that is larger than the diameter of the drain port. When positioned in this fashion, the threaded portion will be positioned at least partially on the outside of the tub. The threaded portion has a maximum diameter that is less than the diameter of the drain port, and is configured to threadably receive a nut. A sealing element may be provided between the bottom surface of the tub and the nut to enhance the interconnection between the tub and the drain port.

In one embodiment, a drain pipe accommodates at least one of a selectively-removable membrane, an integrated strainer body, and a drain closure. The drain closure is also selectively removable from the drain pipe. The drain closure, i.e., stopper, is operatively interconnected to the drain pipe by a carrier post that is interconnected to cross bars integrated into or selectively associated with the drain pipe. For example, the crossbars of one embodiment are threadingly secured to an interior surface of the drain pipe or interference fit into the drain pipe.

The drain pipe may be made of common materials utilized in the art, including, but not limited to, copper, plastic, or any other suitable material.

It is another aspect of the present invention to provide a drain assembly adapted for interconnection to a tub having a drain port formed in a bottom wall, the drain port having a diameter, the drain assembly comprising: a drain pipe including a first portion, a second portion, and an elbow portion positioned between, and integrally connecting, the first portion and the second portion, the first portion including an annular flange and a threaded portion positioned between the annular flange and the elbow portion, wherein the threaded portion, the elbow portion, and the second portion have a maximum diameter that is less than the diameter of the drain port, and wherein the annular flange has a maximum diameter that is larger than the diameter of the drain port; and a nut configured to threadably engage the threaded portion of the drain pipe to secure the drain pipe to the bottom wall of the tub.

It is still yet another aspect of the present invention to provide a drain elbow adapted for interconnection to a tub having a drain port formed in a bottom wall, the drain port having a diameter, the drain elbow comprising: a first portion including an annular flange and an externally threaded portion, the annular flange having a maximum diameter that is larger than the diameter of the drain port; a second portion; and an elbow portion positioned between, and integrally connecting, the first portion and the second portion, wherein the externally threaded portion is positioned between the annular flange and the elbow portion, and wherein the externally threaded portion, the elbow portion, and the second portion have a maximum diameter that is less than the diameter of the drain port.

The Summary is neither intended nor should it be construed as being representative of the full extent and scope of the present disclosure. The present disclosure is set forth in various levels of detail in the Summary of the Invention as well as in the attached drawings and the Detailed Description and no limitation as to the scope of the claimed subject matter is intended by either the inclusion or non-inclusion of elements, components, etc. in this Summary of the Invention. Moreover, reference made herein to "the present invention" or aspects thereof should be understood to mean certain embodiments of the present disclosure and should not necessarily be construed as limiting all embodiments to a particular description.

Figure 1:
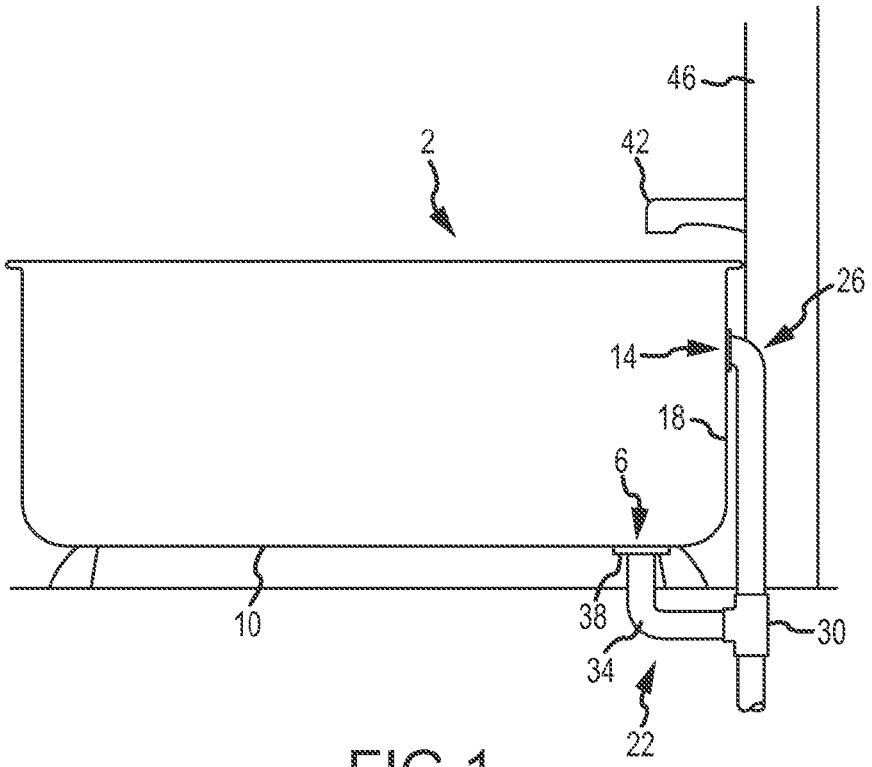
FIG. 1 is a side elevation view of one embodiment of a drain assembly interconnected to a bathtub.
Figure 2:
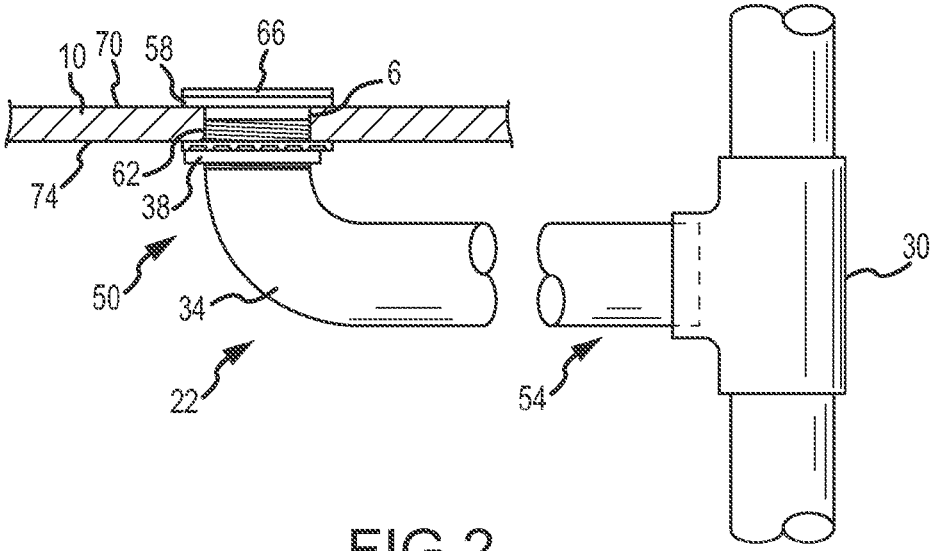
FIG. 2 is a side elevation view of one embodiment of a drain assembly interconnected to a bottom wall of the bathtub.

To assist in the understanding of the drawings, the following is a list of components and associated numbering found in the drawings.

| # | Components |
|---|---|
| 2 | Bathtub |
| 6 | Drain port |
| 10 | Bottom wall |
| 14 | Overflow port |
| 18 | Sidewall |
| 22 | Drain assembly |
| 26 | Overflow assembly |
| 30 | Tee connector |
| 34 | Drain pipe |
| 38 | Nut |
| 42 | Faucet |
| 46 | Interior wall |
| 50 | First end |
| 54 | Second end |
| 55 | Pipe adapter |
| 56 | Pipe |

-continued

| # | Components |
|---|---|
| 57 | Primary drain |
| 58 | Annular flange |
| 62 | Threaded portion |
| 66 | Membrane |
| 70 | Upper surface |
| 74 | Lower surface |
| 78 | Elbow |
| 82 | Drain closure |
| 86 | Crossbar(s) |
| 90 | Cover |
| 94 | Crossbar insert |
| 98 | Hub |
| 102 | Threaded aperture |
| 106 | Carrier |
| 110 | Strainer body cover |
| 114 | Sealing element |
| 118 | Annular lip |
| 122 | Interior surface of drain pipe |
| 126 | Annular ring |
| 130 | Internally threaded portion |
| 134 | Threaded hole |
| 138 | Concave portion |
| 142 | Drain closure insert |
| 146 | Annular groove |

It should be understood that the drawings are not necessarily to scale. In certain instances, details that are not necessary for an understanding of the disclosure or that render other details difficult to perceive may have been omitted. It should be understood, of course, that the claimed subject matter is not necessarily limited to the particular embodiments illustrated herein.

DETAILED DESCRIPTION

Referring to FIGS. 1-5, a bathtub includes a drain port 6 formed in a bottom wall 10 and an overflow port 14 formed in a sidewall 18. A drain assembly 22 is interconnected to the bottom wall 10 around the drain port 6, and an overflow assembly 26 is interconnected to the sidewall 18 around the overflow port 14. A tee connector 30 interconnects the drain assembly 22 and the overflow assembly 26. The drain assembly 22 includes a drain pipe 34, which may be generally L-shaped, and a nut 38. Also illustrated in FIG. 1 is a faucet 42 interconnected to an interior wall 46.

The drain pipe 34 is inserted through the drain port 6 in the bottom wall 10 of the bathtub 2. The drain pipe 34 has a first end 50 associated with the bottom wall 10 of the bathtub 2, and a second end 54 interconnected to the tee connector 30. The first end 50 includes an annular flange 58 and an externally-threaded portion 62. A membrane 66 may be interconnected to the first end 50 of the drain pipe 34 to assist in leak testing.

The drain pipe 34 is interconnected to the bathtub 2 by first inserting it into the drain port 6. The annular flange 58 is then engaged upon the upper surface 70 of the bottom wall 10. A sealant material, which would also create a leak barrier, may be placed on a lower surface of the annular flange 58 for further securing the annular flange to the bottom wall 10 of the bathtub 2. Next, a nut 38 is placed over the second end 54 of the drain pipe 34 and slid along the drain pipe 34 towards the bottom wall until it reaches the threaded portion 62 of the drain pipe 34. The nut 38 is threaded onto the threaded portion 62 of the drain pipe 34 and tightened against a lower surface 74 of the bottom wall 10 which rigidly connects the drain pipe 34 to the bathtub 2 around the drain port 6. Again, a sealing element (See FIG. 6, for example) may additionally be positioned between the nut 38 and the lower surface 74 of the bottom wall 10.

The bottom wall 10 of the bathtub 2 is sandwiched between the annular flange 58 of the drain pipe 34 and the internally-threaded nut 38. After the first end of the drain pipe is interconnected to the bathtub 2, the second end 54 of the drain pipe 34 is connected to a tee connector 30. The drain system which includes the drain assembly 22, overflow assembly 26, and tee connector 30, is leak tested. Finally, a drain closure is operatively associated with the first end 50 of the drain pipe 34. In the foregoing manner, a single individual can interconnect the drain assembly 22 to the drain port 6 of the bathtub 2.

The membrane 66, or diaphragm, is sealed to the first end 50 of the drain pipe 34 at the annular flange 58 for leak testing. In one embodiment, the membrane 66 is hermetically sealed to the first portion 50, and may be constructed of a material that is easily punctured or removable. For example, the membrane 66 may be constructed of a plastic material, flexible rubber, or the like. After a successful leak test, a plumber can remove the membrane 66 with a sharp object.

In most instances a drain closure 82 is associated with the first end 50 of the drain pipe 34. The drain closure 82 can be of any conventional type, including lift and turn, foot-actuated, or PUSH-PULL™ closures to name a few. Likewise, a PRESFLO™ drain closure, such as the one described in U.S. Pat. No. 4,457,030 to Burry, which is incorporated by reference herein, can be used in conjunction with some embodiments of the present invention. A crossbar 86 and hub 98 typically found in strainer bodies is commonly employed. The hub secures a carrier that operatively receives the stopper. The crossbar 86 may be integrated into the drain pipe or otherwise interconnected thereto. A cover 90 may be secured to the flange 58 to substantially cover the same and to provide a finished appearance.

Figure 3:
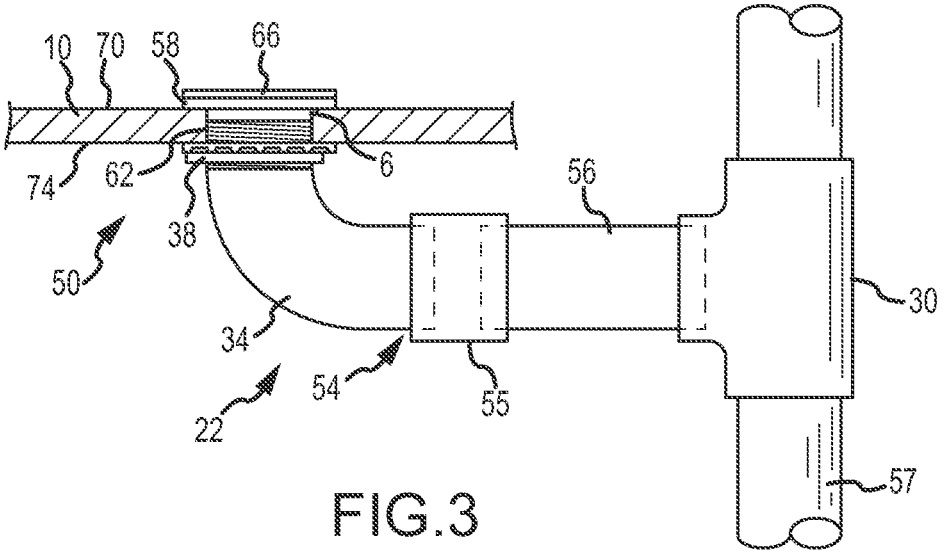
FIG. 3 is a side elevation view of another embodiment of a drain assembly interconnected to a bottom wall of the bathtub.
Figure 4:
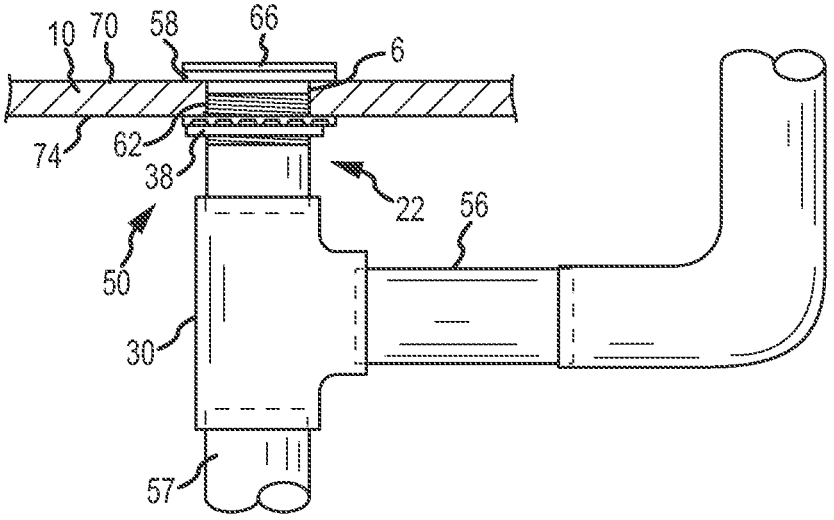
FIG. 4 is a side elevation view of another embodiment of a drain assembly interconnected to a bottom wall of the bathtub.
Figure 5:
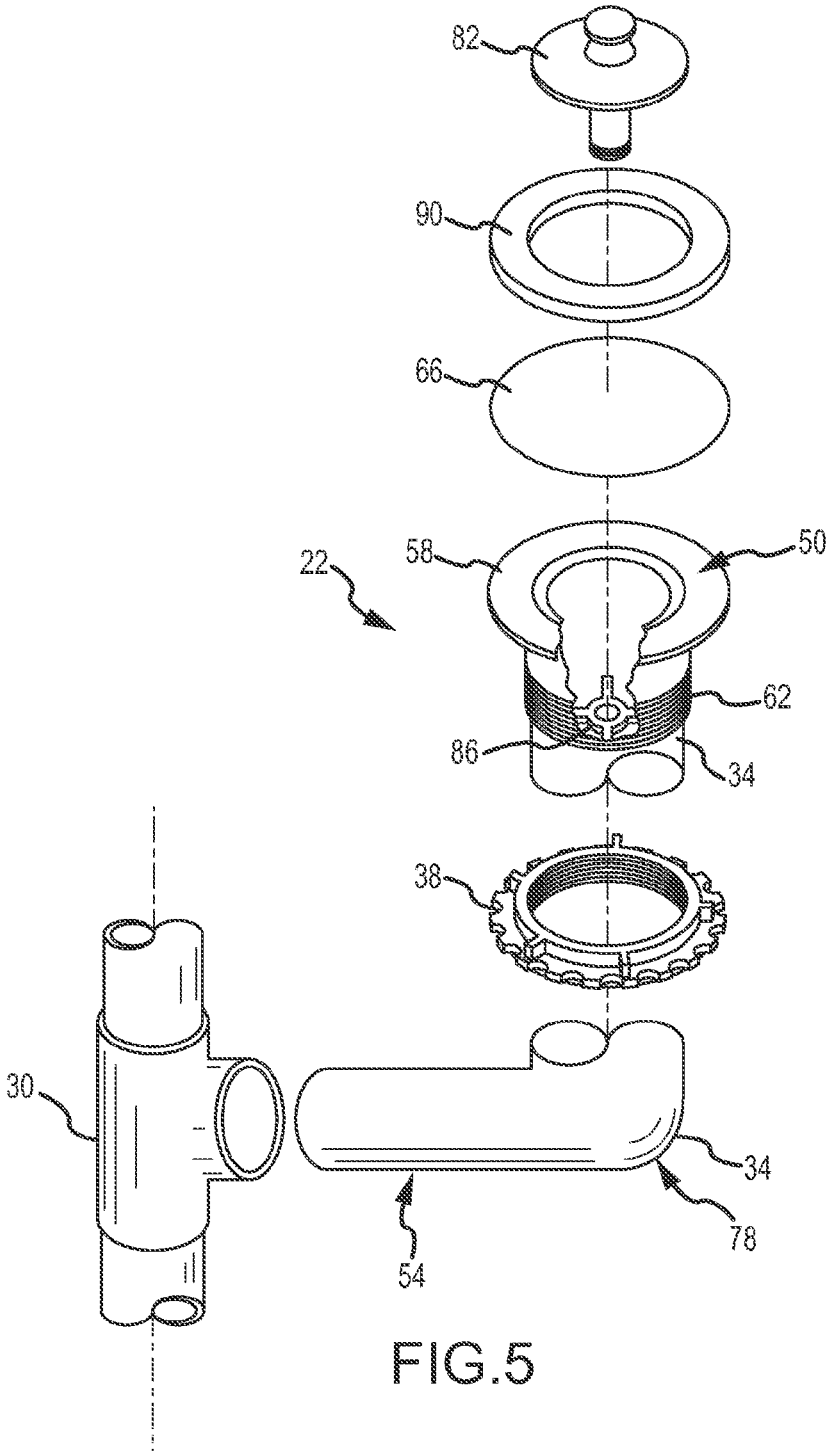
FIG. 5 is an exploded perspective view of one embodiment of a drain assembly and a tee connector.

FIGS. 3 and 4 show other methods interconnecting the drain pipe 34 to the primary drain 57. In FIG. 3, the drain includes an elbow that extends from the annular flange 58. The elbow 34 is interconnected to a pipe 56 by way of an adapter 55. The pipe 56 is also interconnected to a tee connector 30 that connects the primary drain 57 to a pipe associated with the overflow assembly (see FIG. 1, for example). In FIG. 4, the drain assembly includes a vertically-oriented pipe that extends from the annular flange 58. The drain assembly 22 is interconnected directly to the tee connector 30 which is also interconnected to the primary drain 57 and to a pipe 56 associated with the overflow assembly. These two alternate methods of interconnecting the drain assembly 22 provide more installation options and flexibility to the plumber. Those of skill in the art will appreciate that various other ways can be employed to interconnect the drain assembly 22 to the overflow assembly and to the primary drain plumbing 57 of the dwelling.

Figure 6:
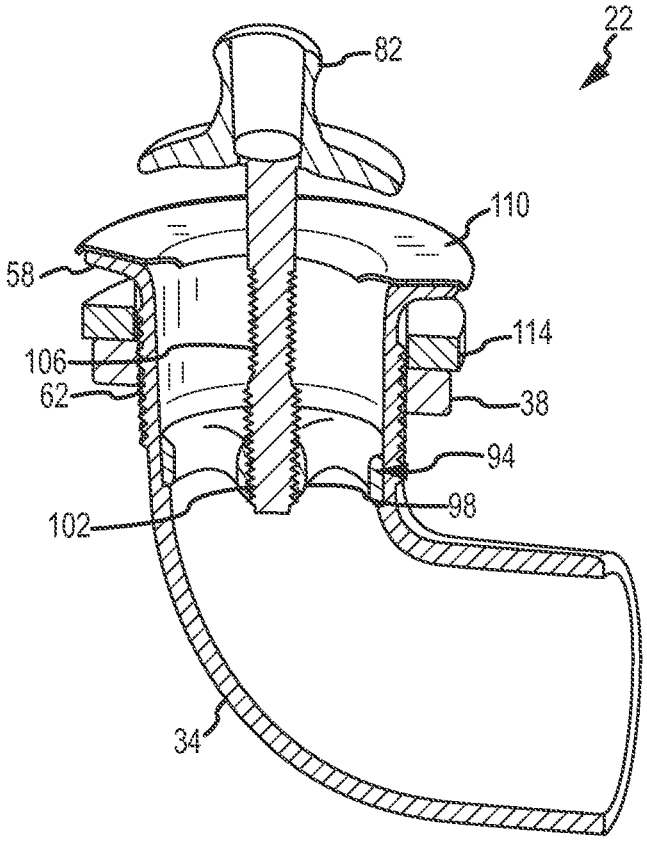
FIG. 6 is a cross-section perspective view of one embodiment of a drain assembly including a drain closure threadably engaged to an insert.

FIG. 6 depicts one embodiment of a drain assembly 22 that includes a drain closure 82 interconnected to a crossbar insert 94. The crossbar insert 94 includes a hub 98 having a threaded aperture 102 configured to receive a threaded end of a carrier 106 that slidingly receives the drain closure 82. The carrier 106 is inserted through a strainer body cover 110, which is interconnected to the flange 58. As in the embodiments described above, a nut 38 is threadably engaged onto the threaded portion 62 with a sealing element 114 positioned therebetween.

Figure 7:
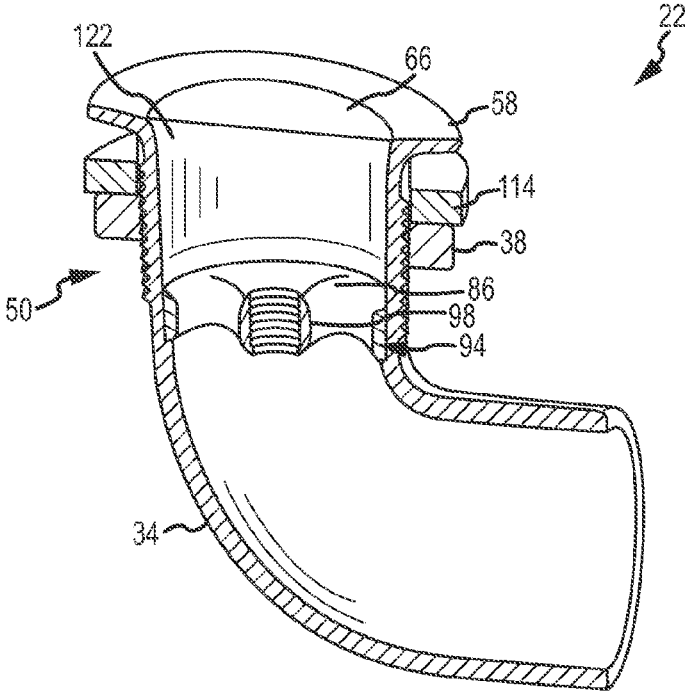
FIG. 7 is a cross-section perspective view of one embodiment of a drain assembly including a membrane and an insert.
Figure 8:
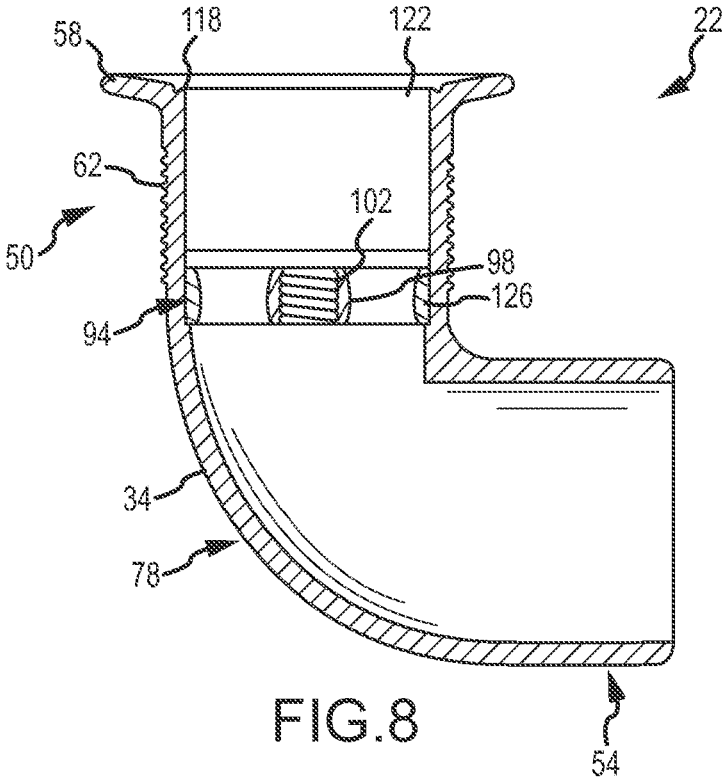
FIG. 8 is a cross-section elevation view of one embodiment of a drain assembly including a crossbar insert.

FIGS. 7 and 8 illustrate one embodiment of a drain assembly 22 that employs a membrane 66 and a crossbar insert 94 having a threaded hub 98. The membrane 66 is positioned over at least a portion of the flange 58 or affixed to an annular lip 118 of the drain closure 34 at the first end 50 of the drain elbow 34. The annular lip 118 is formed in the upper surface of the annular flange 58 as the flange 58 transitions to the interior surface 122 of the first end 50 of the drain pipe 34. In an alternative embodiment, the annular lip 118 is formed in an interior surface of the first end 50 of the drain pipe 34. The annular lip 118 can be configured to interconnect various devices to the drain pipe 34, including, but not limited to, a membrane 66, a cover 110, and a strainer body.

Figure 9:
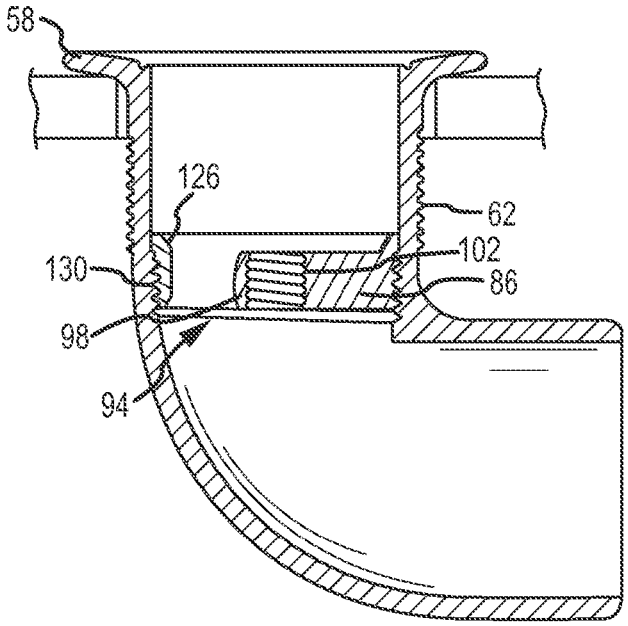
FIG. 9 is a cross-section elevation view of one embodiment of a drain assembly including a threaded insert.
Figure 10:
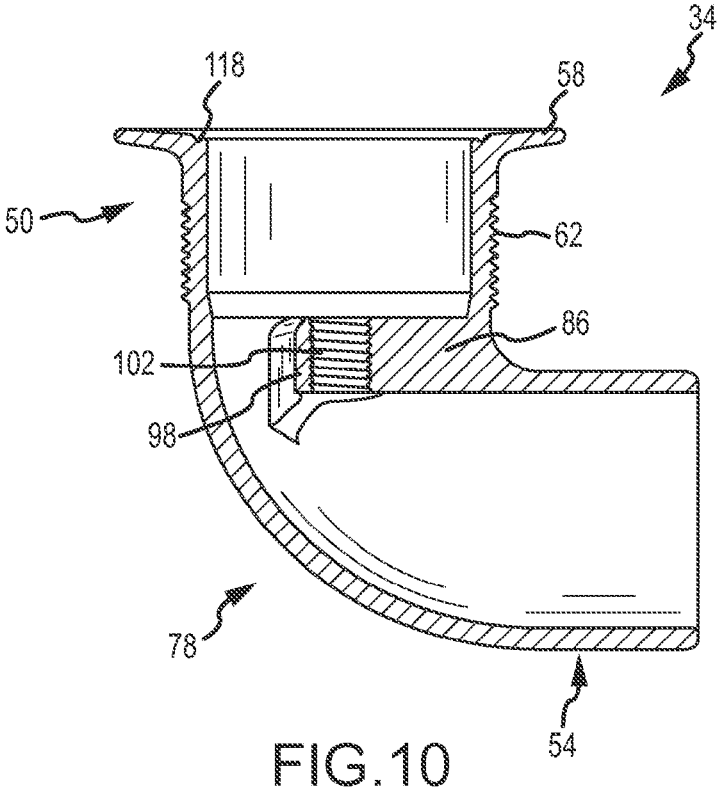
FIG. 10 is a cross-section elevation view of one embodiment of a drain pipe including an integral crossbar for receipt of a drain stopper carrier.

Referring to FIGS. 8-10, various ways of positioning crossbars within the drain pipe are depicted. In one embodiment, the crossbar 94 is interference fit into the drain pipe 34. The crossbar insert 94 includes the at least one crossbar 86 that interconnects an annular ring 126 to the hub 98. The hub 98 may include a threaded aperture 102 configured to threadably receive the threaded end of a carrier, which operatively receives a drain closure 82.

Referring to FIG. 9, a crossbar insert 94 includes a threaded annular ring 126 that threadably engages a threaded portion 130 of the drain pipe 34.

FIG. 10 shows a crossbar 86 integrally formed in the drain pipe 34.

Figure 11:
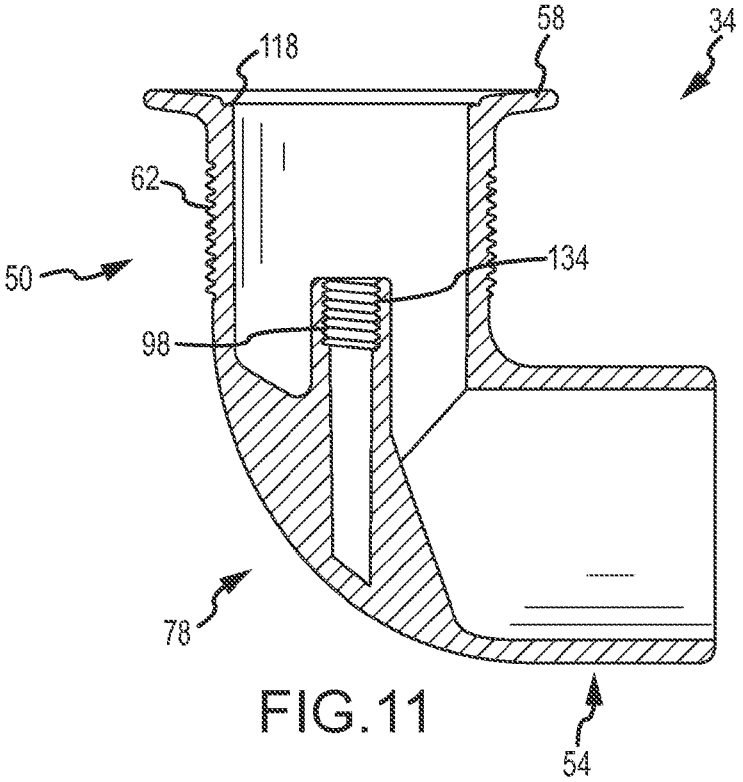
FIG. 11 is a cross-section elevation view of one embodiment of a drain pipe including an upwardly-extending hub for receipt of a drain stopper carrier.
Figure 12:
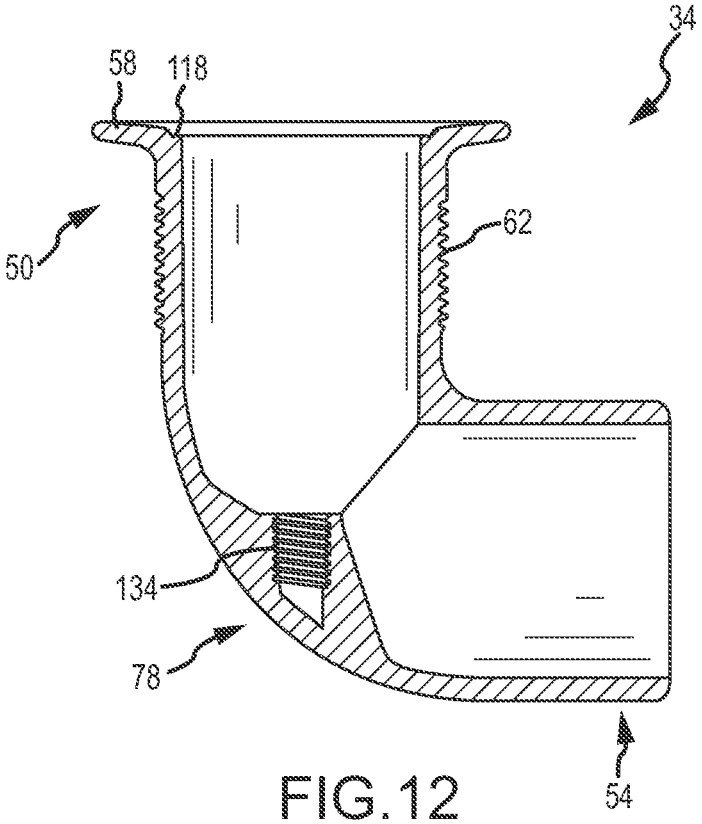
FIG. 12 is a cross-section elevation view of one embodiment of a drain pipe including a threaded hole formed in the elbow portion for receipt of a drain stopper carrier.

FIGS. 11-12 illustrate other methods of integrating the crossbar and associated hub with the drain pipe. In FIG. 11, an upwardly extending hub 98 is integrally connected to the elbow 78 of the drain pipe 34. The hub 98 extends into an interior space near the first end 50 of the drain pipe 34 and includes a threaded hole 134 that receives a threaded end of the carrier 106.

Figure 13:
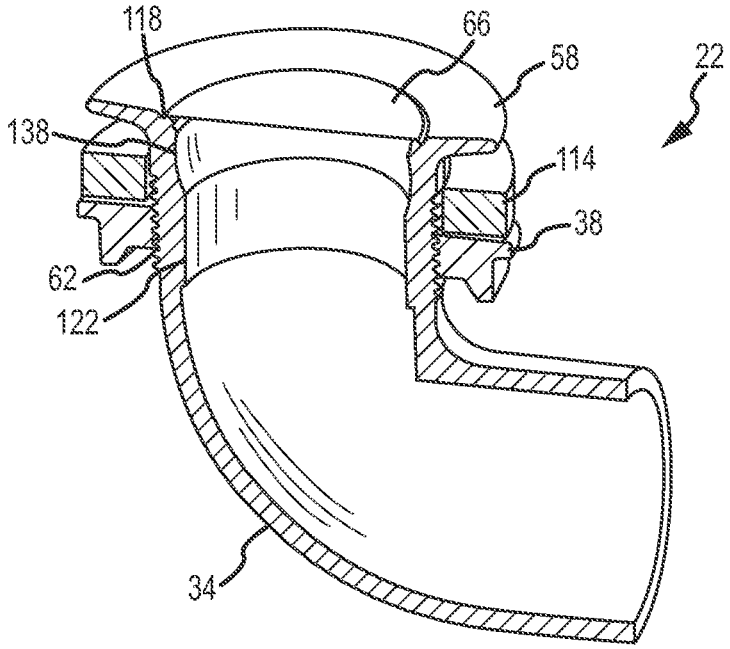
FIG. 13 is a cross-section perspective view of a drain assembly including a membrane, a nut, a sealing element, and a drain pipe having a concave inner surface.
Figure 14:
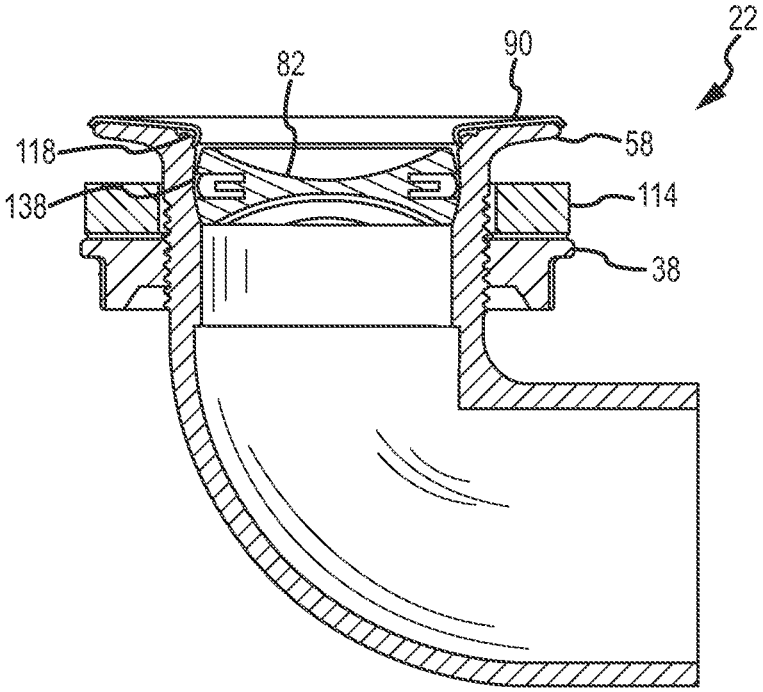
FIG. 14 is a cross-section elevation view of one embodiment of a drain assembly including a finishing plate and a drain closure interconnected to a drain pipe.
Figure 15:
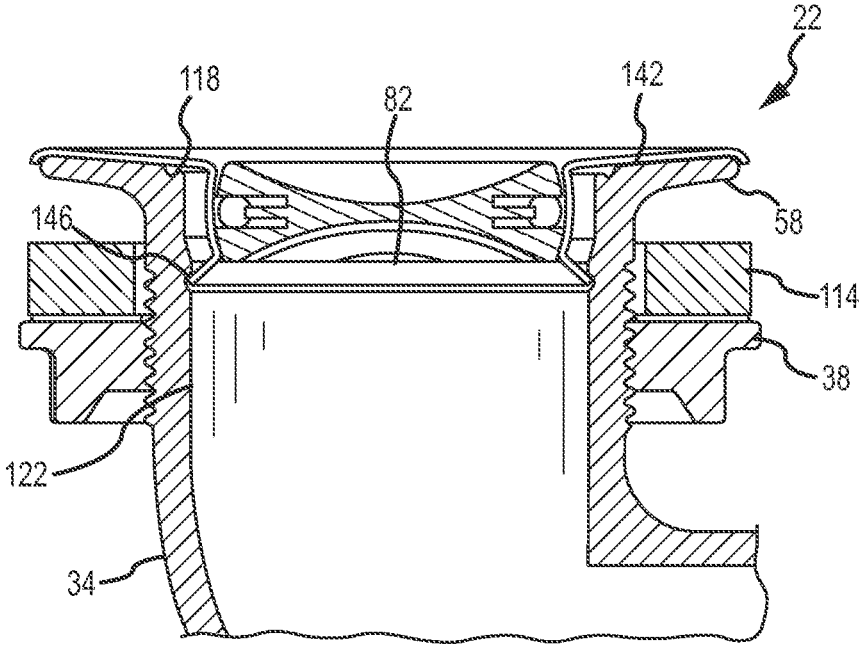
FIG. 15 is a cross-section elevation view of one embodiment of a drain assembly including downwardly-extending finishing plate with a drain closure interconnected thereto.

Referring now to FIGS. 13-15, various embodiments of a drain assembly 22 utilizing a drain closure 82 are provided. FIG. 13 depicts a drain pipe 34 that includes a concave portion 138 formed in an interior surface 122 that is configured to receive a drain closure 82 that is snapped, or interference fit, within the concave portion 138 of the drain pipe 34. In one embodiment, the concave portion 138 of the drain pipe 34 receives a PRESFLO™ drain closure. Also illustrated in FIG. 14, a cover 90, which often includes a strainer, may be interconnected to the drain pipe 34 to prevent hair from entering the drain pipe, for example. In one embodiment, the cover 90 is interference fit into the annular flange 58 and the annular lip 118 of the drain pipe 34.

FIG. 15 shows a drain closure insert 142 that is interconnected to the drain pipe 34 and is capable of accommodating the drain closure device.

The drain assembly as described herein may be used in conjunction with the drain stopper as taught by U.S. patent application Ser. No. 61/657,434, which is incorporated by reference in its entirety herein.

While various embodiments have been described herein in detail, it is apparent that modifications and alterations of those embodiments will occur to those skilled in the art. It is to be expressly understood that such modifications and alterations are within the scope and spirit of the claimed invention, as set forth in the following claims.

What is claimed is:

1. A drain assembly adapted for interconnection to a tub having a drain port formed in a bottom wall, the drain port having a diameter, the drain assembly comprising:

a drain pipe including a first portion, a second portion, and an elbow portion positioned between, and integrally connecting, said first portion and said second portion, said first portion including an annular flange and a threaded portion positioned between said annular flange and said elbow portion, wherein said threaded portion, said elbow portion, and said second portion have a maximum diameter that is less than the diameter of the drain port, and wherein said annular flange has a maximum diameter that is larger than the diameter of the drain port; and a nut configured to threadably engage said threaded portion of said drain pipe to secure said drain pipe to the bottom wall of the tub.

2. The drain assembly of claim 1, further comprising a sealing element positioned between the annular flange and the nut.

3. The drain assembly of claim 1, wherein said first portion further comprises a lip formed in an upper surface of said annular flange.

4. The drain assembly of claim 3, further comprising a membrane interconnected to said lip.

5. The drain assembly of claim 3, further comprising a strainer body interconnected to said lip.

6. The drain assembly of claim 3, further comprising a strainer body cover interconnected to said lip.

7. The drain assembly of claim 1, wherein said first portion has an inner surface having a concave portion.

8. The drain assembly of claim 7, further comprising a drain closure seated in said concave portion of said first portion.

9. The drain assembly of claim 1, further comprising crossbars integrally formed within the first portion of said drain pipe.

10. The drain assembly of claim 1, further comprising a membrane interconnected directly to the annular flange.

11. A drain elbow adapted for interconnection to a tub having a drain port formed in a bottom wall, the drain port having a diameter, the drain elbow comprising:

a first portion including an annular flange and an externally threaded portion, said annular flange having a maximum diameter that is larger than the diameter of the drain port;

a second portion; and an elbow portion positioned between, and integrally connecting, said first portion and said second portion, wherein said externally threaded portion is positioned between said annular flange and said elbow portion, and wherein said externally threaded portion, said elbow portion, and said second portion have a maximum diameter that is less than the diameter of the drain port.

12. The drain elbow of claim 11, wherein said first portion further comprises a lip formed in an upper surface of said annular flange adjacent to an opening of said drain elbow, wherein said lip is configured to receive at least one of a membrane, a strainer body, and a strainer body cover.

13. The drain elbow of claim 11, further comprising a crossbar interconnected to an interior surface of said drain elbow.

14. The drain elbow of claim 13, wherein said crossbar is integrally formed in said interior surface of said drain elbow.

15. The drain elbow of claim 13, wherein said crossbar is threadably secured to said interior surface of said drain elbow.

16. The drain elbow of claim 13, wherein said crossbar is interference fit within said interior surface of said drain elbow.

17. The drain elbow of claim 13, wherein said crossbar includes a hub having a threaded aperture configured to receive a threaded post of a drain closure.

18. The drain elbow of claim 11, wherein an interior surface of said first portion includes a concave portion configured to receive a drain closure.

* * * * *